US009381396B2

(12) United States Patent
Colan et al.

(10) Patent No.: US 9,381,396 B2
(45) Date of Patent: Jul. 5, 2016

(54) PORTABLE PROGRESSIVE RESISTANCE EXERCISE DEVICE

(71) Applicant: SportCrafters, Inc., Granger, IN (US)

(72) Inventors: Peter V Colan, Elkhart, IN (US); Patrick T Kulwicki, South Bend, IN (US)

(73) Assignee: SportCrafters, Inc., Granger, IN (US)

( * ) Notice: Subject to any disclaimer, the term of this patent is extended or adjusted under 35 U.S.C. 154(b) by 0 days.

(21) Appl. No.: 14/612,686

(22) Filed: Feb. 3, 2015

(65) Prior Publication Data

US 2015/0217158 A1 Aug. 6, 2015

Related U.S. Application Data

(60) Provisional application No. 61/935,583, filed on Feb. 4, 2014.

(51) Int. Cl.
*A63B 22/06* (2006.01)
*A63B 69/16* (2006.01)

(52) U.S. Cl.
CPC ..... *A63B 22/0605* (2013.01); *A63B 69/16* (2013.01); *A63B 2069/161* (2013.01); *A63B 2069/163* (2013.01); *A63B 2069/167* (2013.01); *A63B 2210/50* (2013.01)

(58) Field of Classification Search
CPC ..... A63B 69/16; A63B 2069/161; A63B 2069/162; A63B 2069/163; A63B 2069/164; A63B 2069/165; A63B 2069/166; A63B 2069/167; A63B 2069/168; A63B 2022/0641; A63B 22/0605; A63B 22/06; A63B 21/0051; A63B 21/005; A63B 2210/50
USPC ..... 482/910, 907
See application file for complete search history.

(56) References Cited

U.S. PATENT DOCUMENTS 4,026,546 A * 5/1977 Omori ..... A63B 69/16 211/22
4,595,194 A * 6/1986 Previtali ..... A63B 69/16 482/61
4,976,424 A * 12/1990 Sargeant ..... A63B 21/0053 482/3
6,042,517 A 3/2000 Gunther et al.
6,712,737 B1 * 3/2004 Nusbaum ..... A63B 69/16 482/57
6,857,992 B1 2/2005 Kolda et al.
6,945,917 B1 * 9/2005 Baatz ..... A63B 21/0051 482/57
6,964,633 B2 11/2005 Kolda et al.

(Continued)

FOREIGN PATENT DOCUMENTS

EP 0621058 A1 10/1994
EP 1683550 A1 7/2006

(Continued)

*Primary Examiner* — Oren Ginsberg
*Assistant Examiner* — Nyca T Nguyen
(74) *Attorney, Agent, or Firm* — Botkin & Hall, LLP

(57) ABSTRACT

A collapsible folding training device is provided having a rear frame portion that contains a resistance device. The resistance device uses eddy currents and has a pivoting magnet internally that creates progressively increasing resistance as speed increases. An arm is attached to the rear frame portion that can pivot from a stored position to an in-use position. At the opposite end of the arm, a front frame is attached where it can affix a portion of a driving mechanism, such as a bicycle. The front frame supports and stabilizes the driving mechanism. The arm sets the distance between the front frame and the resistance device.

13 Claims, 10 Drawing Sheets

(56) References Cited

U.S. PATENT DOCUMENTS

| | | | | |
|---|---|---|---|---|
| 7,011,607 | B2 | 3/2006 | Kolda et al. | |
| 7,585,258 | B2 | 9/2009 | Watson et al. | |
| 8,430,797 | B2 * | 4/2013 | Wan | A63B 69/16 482/61 |
| 2002/0137601 | A1 * | 9/2002 | Tobias | A63B 21/0088 482/52 |
| 2005/0064999 | A1 | 3/2005 | Qiu | |
| 2005/0209064 | A1 * | 9/2005 | Peterson | A63B 22/16 482/61 |
| 2006/0217237 | A1 * | 9/2006 | Rhodes | A63B 21/225 482/61 |
| 2009/0283648 | A1 * | 11/2009 | Chiang | A63B 69/16 248/187.1 |
| 2014/0296038 | A1 * | 10/2014 | Colan | A63B 69/16 482/61 |
| 2015/0133272 | A1 * | 5/2015 | Papadopolous | A63B 69/16 482/61 |

FOREIGN PATENT DOCUMENTS

| | | | | |
|---|---|---|---|---|
| FR | 2315962 | A1 * | 1/1977 | A63B 69/16 |
| WO | 2010/104405 | A2 | 9/2010 | |

* cited by examiner

PORTABLE PROGRESSIVE RESISTANCE EXERCISE DEVICE

CROSS REFERENCE TO RELATED APPLICATIONS

This application claims the benefit of U.S. Provisional Application No. 61/935,583, filed Feb. 4, 2014, the disclosures of which are hereby incorporated by reference.

BACKGROUND OF THE INVENTION

Bicycle rollers have been in use since the early 1900's. A bicycle roller is a dynamometer for bicycles that is powered by the bicycle rider. A portable bicycle roller is traditionally comprised of one or more rotatable cylinders positioned so that the rear wheel of the bicycle rides on at least one cylinder, and one of the axles of the bicycle is fixed for stability. In the typical application, the front wheel is removed and the front fork of the bicycle is fixed to prevent the rider from tipping over.

In the prior art, the amount of power, or wattage, that the bicyclist is required to exert to ride at a given speed on a bicycle roller was determined by the amount of rolling resistance resulting from tire distress as the tire rolls over each of the cylinders plus the wattage required to drive any external devices which exert resistance on one or more of the cylinders. Rolling resistance is predominantly a function of the cylinder diameter, tire pressure, and bicyclist weight. Relying on these factors alone provides a linear relationship of resistance versus speed. Simple devices that add a predictable amount of resistance such as the magnetic eddy-current device of U.S. Pat. No. 6,857,992 (incorporated herein by reference) can be added externally to the cylinders, but these are undesirable since they provide a linear speed-to-resistance relationship.

Prior art bicycle rollers have a linear relationship of speed versus resistance. This solution is unsatisfactory; when beginning to pedal the bike from rest on rollers, low resistance is desired to allow the wheels to accelerate quickly enough to enable sufficient steering dynamics to keep the bicycle stable on the rollers. However, to obtain a meaningful training session, a high amount of resistance is desired when pedaling at a rate suitable to achieve cardiovascular exercise benefit.

To achieve both objectives it is desired to have a progressive resistance relationship with speed. In other words, a non-linear relationship between speed and resistance where the slope of resistance versus speed increases with increasing speed. This relationship is preferred because it more effectively simulates the non-linear effect of combined rolling resistance and wind resistance experienced when riding a bicycle in traditional fashion.

Eddy current devices use magnetism to generate electrical current in conductive materials when a magnetic field is placed in relative close proximity to the conductive material and relative motion of the magnet to the conductive material is present. The motion creates small electrical currents in the conductive material. The current creates a non-contacting friction between the two, along with generating heat in the conductive material. This heat must be dissipated in some fashion. Prior art resistance trainers utilize a large surface area on the roller(s) to dissipate the heat that is generated during use. For portable devices, parts must be made smaller to facilitate transportation and storage. This leads to a heat management issue, Prior art used a cylinder that contacted the rider's tire on the exterior and had the eddy current friction mechanism on the interior. With a large surface area, along with a good thermal conductor, it was possible to share the two uses with a single-walled cylinder. Reducing the size of the cylinder, while still maintaining the load capacity of the cylinder, it was necessary to add some additional form of thermal management. An improved eddy current device is needed.

SUMMARY OF THE INVENTION

The present disclosure describes an improved eddy current resistance device that fits into a smaller physical envelope, while still being able to provide the resistance of a much larger resistance device. By creating a cavity between the outer wall that carries the mechanical load of the rider's tire and the inner wall that generates the heat, it is possible to reduce overall size without compromising overall capacity. To dissipate the heat generated by the interior wall, fins directing air flow in the cavity between the outer and inner cylinder can be incorporated on the sides of the cylinder. The inner and outer cylinder can be connected through support members between the outside diameter of the inner cylinder and the inside diameter of the outer cylinder. These support members can be incorporated as part of an extrusion that makes the cylinders and support members one piece. The inner and outer cylinders can also be connected through the bearing support structure that allows the cylinders to rotate about the central axis. As such, a workable portable bicycle roller is desired.

Further, the progressive resistance device described herein is applicable to other stationary trainers, such as those sold for use with bicycles, handcycles and tricycles (see U.S. Pat. Nos. 7,011,607, 7,585,258, 6,964,633, and 6,042,517, each incorporated herein by reference). The progressive resistance device described herein is distinguishable from the magnetic resistance system for rollers (U.S. Pat. No. 6,857,992, incorporated herein by reference) in that the progressive resistance device automatically adjusts resistance level relative to speed, rather than being manually adjustable.

BRIEF DESCRIPTION OF THE DRAWINGS

A preferred embodiment of this invention has been chosen wherein.

DESCRIPTION OF THE PREFERRED EMBODIMENT

Figure 1:
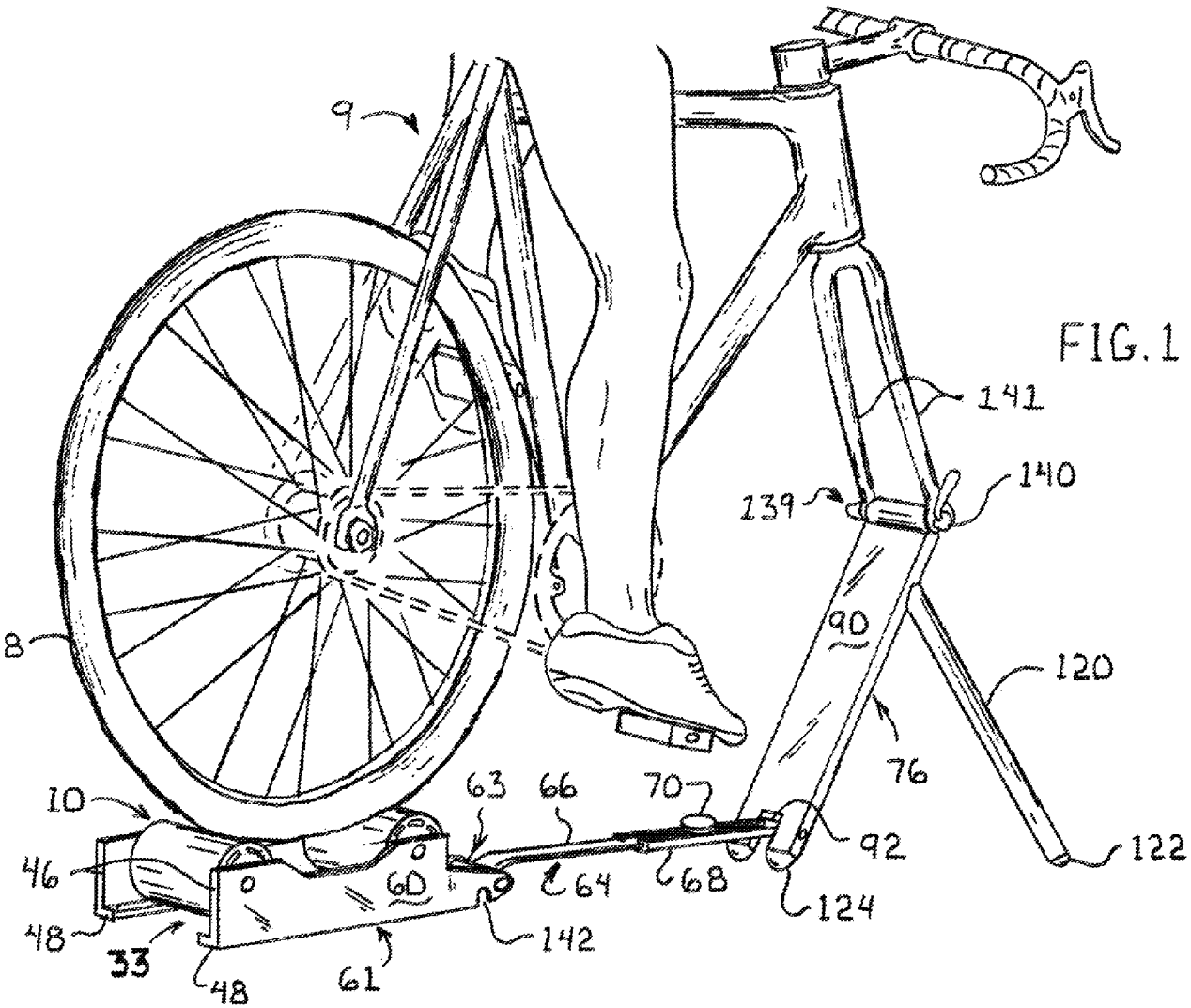
FIG. 1 is an isometric view of a bicycle attached to the device.
Figure 2:
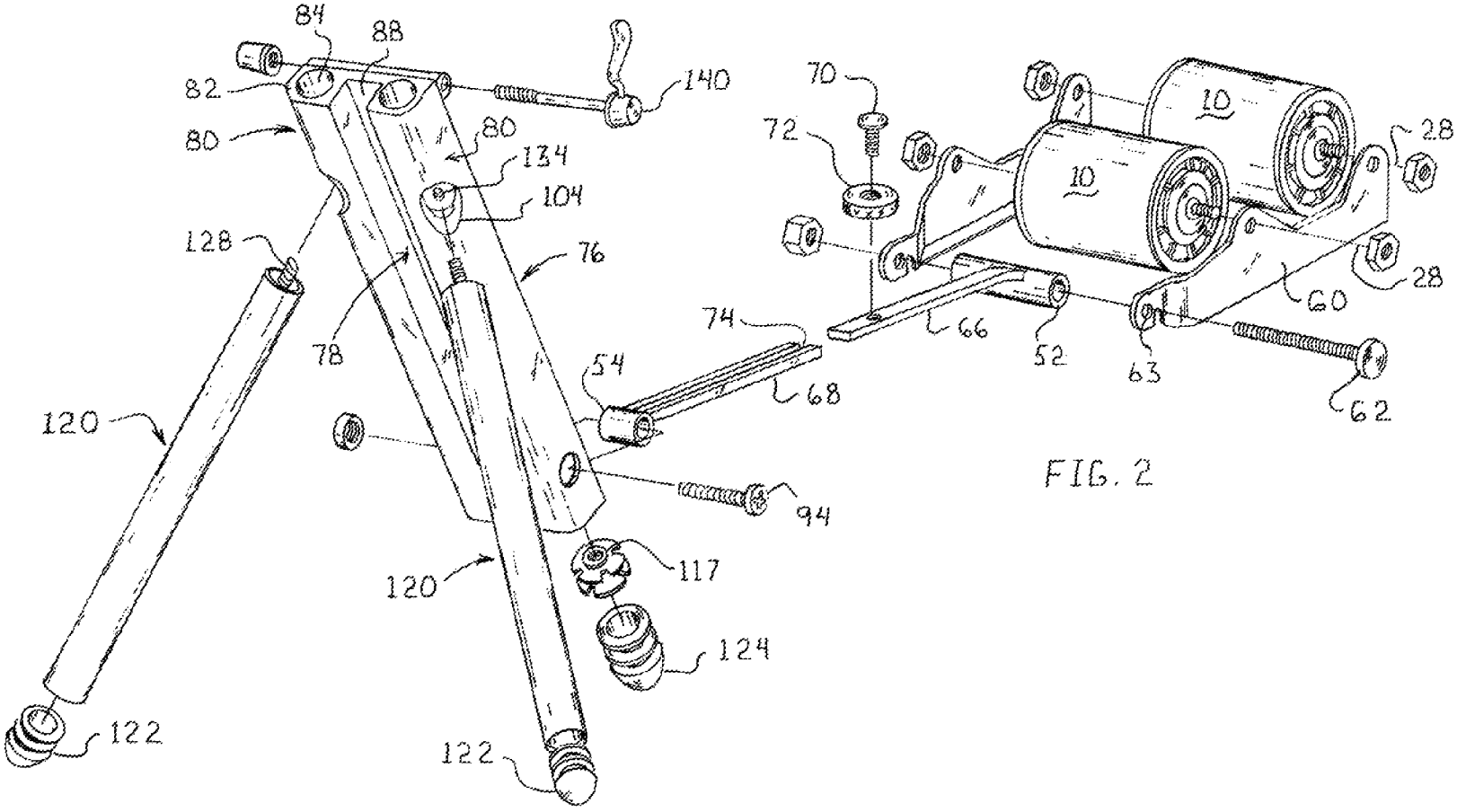
FIG. 2 is an exploded isometric view of the device.
Figure 3:
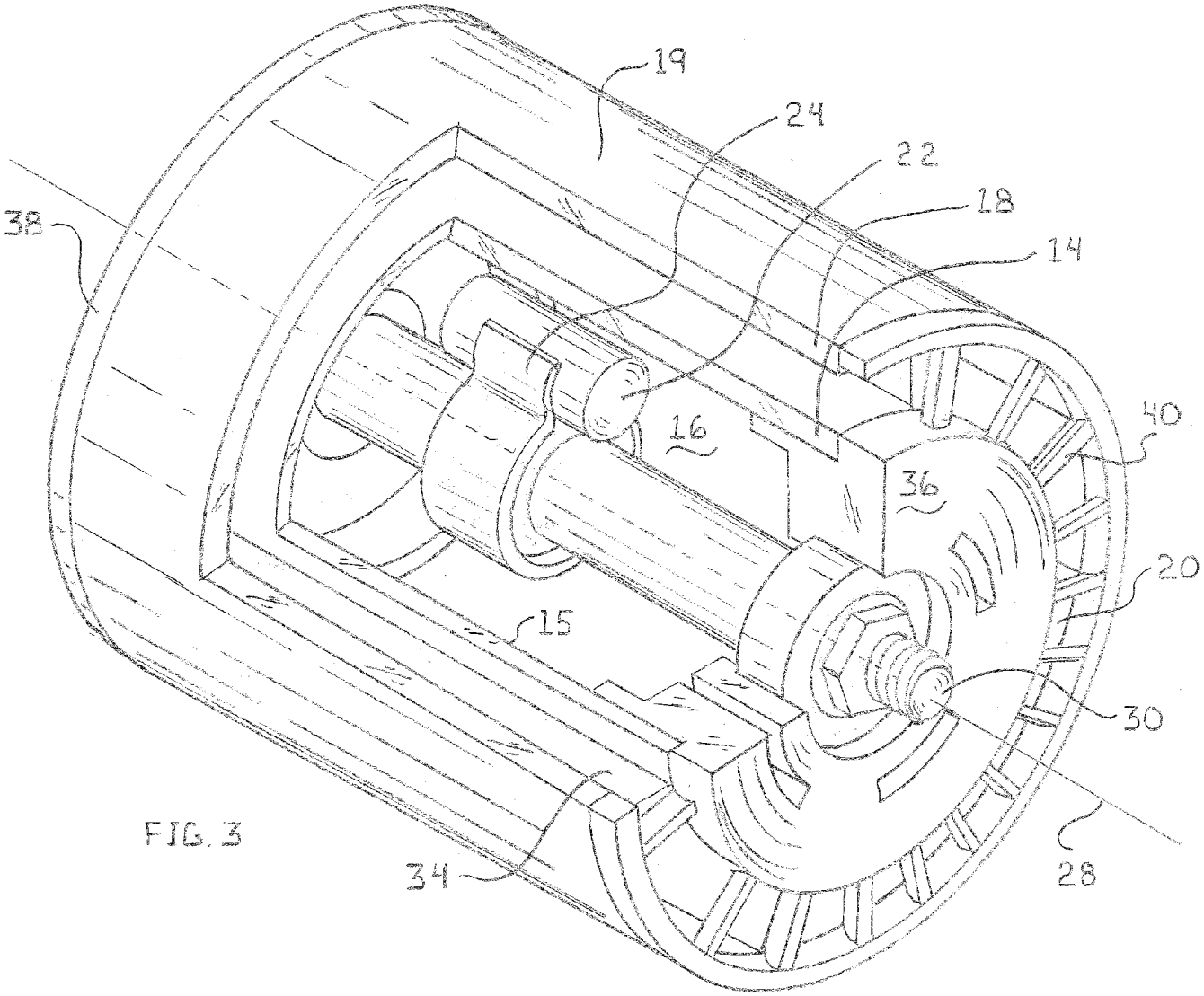
FIG. 3 is an isometric view of the resistance device.
Figure 5:
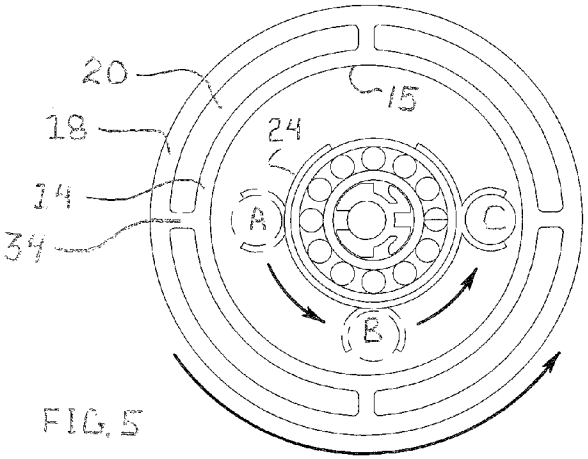
FIG. 5 is a cross section of the device showing the mechanical stop.
Figure 4:
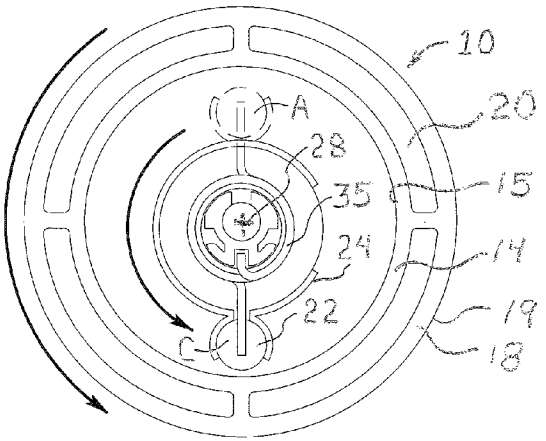
FIG. 4 is a cross section of the device showing the magnet position vs cylinder speed.
Figure 6:
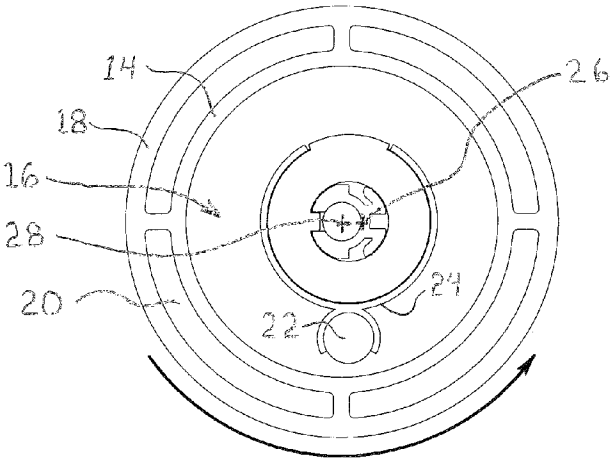
FIG. 6 is a cross section of the device showing the return spring.

This disclosure describes an improved portable progressive resistance device 10 suitable for integration with a bicycle roller training device 12. The resistance device is shown with a driving mechanism, such as a bicycle 9 in FIG. 1 and the device as mounted on a training device 12 is shown in FIGS. 1 and 2. The progressive resistance device 10 is a conductive inner cylinder 14 (FIG. 3), having an inner surface 15 defining an internal chamber 16. The inner cylinder 14 also has an outer wall 18 with an external surface 19 that circumscribes the first, defining an annular area 20 between the two. One or more magnets 22 is carried on a pivotal magnet carrier 24 in proximity to inner surface 15 and housed within the internal chamber 16. Eddy currents produced in the inner cylinder 14 create a non-contacting frictional drag as the inner cylinder 14 spins relative to the magnet(s) 22. This drag causes a force that attempts to pull the magnet 22 from a resting position A (as shown in FIGS. 4-6) along with the rotation of the inner cylinder 14. The magnet 22 is mounted on a magnet carrier 24 that pivots on an axis 26 (FIG. 6) that is eccentrically offset from the rotational axis 28 of the cylinder. This rotation alters the magnet's proximity to the inner surface 15 by pulling the magnet carrier 24 to move in an eccentric orientation as relates to the rotational axis 28 of the cylinder. A torsional spring 35 (FIG. 4) opposes the force created by the eddy current and causes the system to achieve a state of equilibrium force balance. The pivotal position of the magnet carrier 24 to the inner cylinder 14 is closer as shown in position B and closer yet as shown in position C (FIG. 5) as cylinder 14 speed increases.

Figure 7:
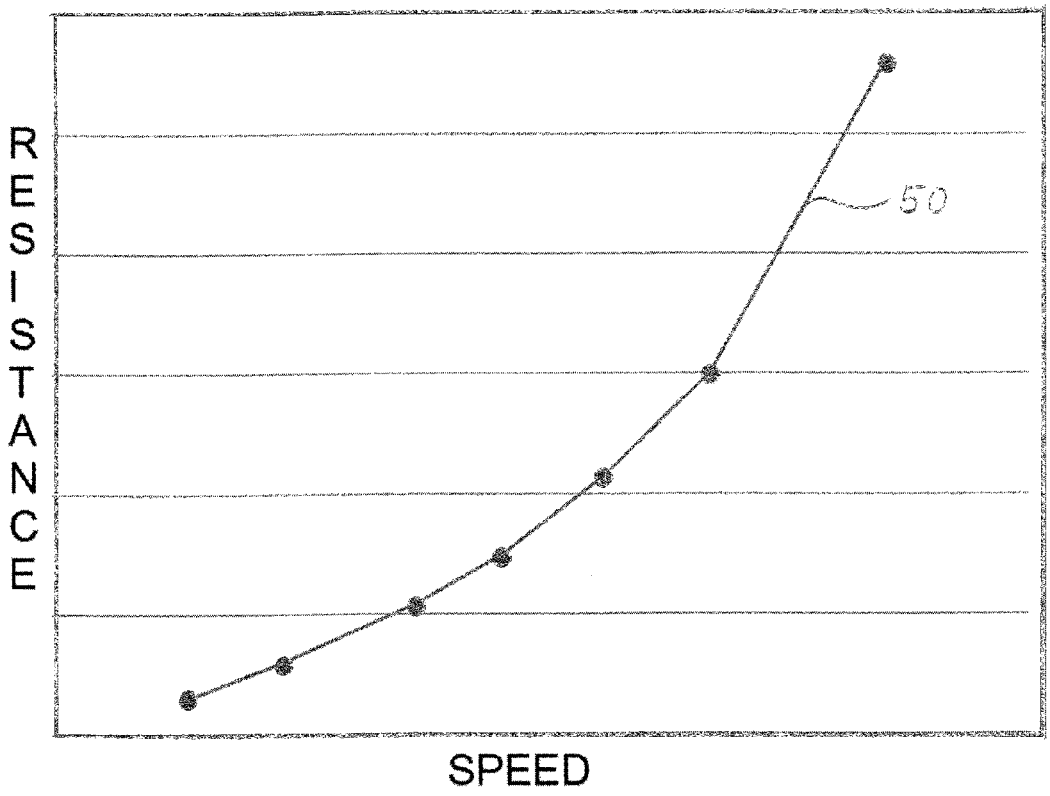
FIG. 7 is a graph showing resistance vs speed.

With the cylinder oriented such that rotation allows the magnet carrier to move against the torsional spring 35 (FIG. 4), the result is a non-linear progressive relationship between speed and resistance 50 as is shown in FIG. 7.

Another benefit of the progressive resistance device described herein is that when a linear relationship between speed and resistance is desired, a rotational stop may be implemented on the pivotal magnet carrier so that pivotal angle is limited, preventing the magnet(s) 22 from getting closer to the inner cylinder 14 when the rotational direction of the cylinder is reversed. The inner cylinder 14 can rotate in an opposite direction described above—allowing the same progressive resistance device 10 to provide either linear or proportional training depending on the direction of rotation of the inner cylinder 14. With the progressive resistance device reversed, the result will be a linear relationship of speed and resistance. Therefore, the progressive resistance device 10 described herein is unique in that it allows the user to select progressive resistance or linear resistance, as desired. The ability to make this selection is important because users training on rollers on any given day may prefer progressive resistance in one session and linear resistance in another session. In practice, the progressive resistance device is removable from the roller frame 61 (FIG. 1) and is reversible, to allow the user to select linear or progressive resistance.

For most bicycle riders, the use of a trainer having a single progressive resistance device described herein may be adequate. However, because a bicycle roller can comprise more than one device 10, the use of one or two progressive resistance devices described herein may be used in the place of the roller's cylinders to achieve differing levels of resistance. In other applications, a second roller is simply an idler and provides little to no rolling resistance.

By adjusting the spring rate, spring preload, number of magnets 22, and other variables it is possible to adjust the progressive relationship between resistance and speed 50 to suit the needs of the designer or the user.

Because of the heat generated by the eddy currents in the inner cylinder 14 during use, the second wall 18 and annular space 20 (FIG. 3) between the two cylinders may be necessary to prevent excessive heat from reaching the surface where the external surface 19 meets the tire 8. The annular space 20 between the cylinders 14, 18 can provide a thermal barrier between the cylinders and allow a cooling medium (typically air) through which it can pass to expel excessive heat. The inner 14 and outer 18 cylinders are mechanically connected, either by support structure 34 (FIG. 3) between the two or through the mounting of the cylinder to the axle through a bearing support 36, 38 (FIG. 3). Improved heat dissipation can be achieved through the implementation of cooling fins 40 on the bearing supports 36, 38 that mount the cylinders to the axle 30. The cooling fins 40 can be arranged on the bearing supports 36, 38 in such a manner to direct the flow of the cooling medium from one end of the cylinder to the other, thereby pulling heat from the assembly as the rider uses the device. One embodiment of the forced air cooling involves cooling fins 40 on the outer diameter of the bearing supports 36, 38 that pull air in on one side and force it out on the other side. Since the cylinder only produces heat while it is in motion, any features that move air during rotation are effective without requiring additional complexity or parts. It is also possible to incorporate features in the support structure 34 between the first and second cylinders 14, 18 such that the same cooling is accomplished as the cylinders 14, 18 are rotated relative to the axle 30. This could be from fan shaped assemblies integrated in bearing supports 36, 38 that are installed on at least one end of the cylinders 14, 18. Blades 40 integrated into the bearing supports pull cooler air in from one end of the cylinder and expel it through the opposite end. Cooling requirements may only dictate that one end of the cylinder incorporates fan shaped features to generate airflow.

An additional embodiment of this technology, to achieve a higher level of resistance on a single cylinder, is to include stationary magnets on the outer side of the progressive resistance device placed and oriented when the progressive resistance device is at rest. The poles of the moveable magnets inside the cylinder will oppose the stationary magnets outside the cylinder, thereby reducing the magnetic flux on the conductive cylinder wall and, when the progressive resistance device rotates during its normal operation, the moveable magnets inside the cylinder approach stationary magnets on the outside of the cylinder in such a way that the magnets are attracted by appropriate pole alignment; thereby increasing the magnetic flux on the conductive cylinder wall.

Applications of this technology are not limited to bicycle rollers and bicycle trainers, but are suitable in any application where a resistance mechanism is employed and it is desired that the resistance mechanism have a non-linear relationship to speed, such as a stationary bicycle, hand cycle ergometers, or any similar device. Because the progressive resistance device described herein is contained within a cylindrical drum and requires only that the cylinder be rotated relative to the axle, it can be driven by direct contact with a bicycle tire, or it can employ a chain and sprocket, a drive belt, or can be driven directly by any means to cause rotation of a cylinder on an axle.

A portable roller-type stationary bicycle trainer 12 includes a cycle attachment 139 shown in FIG. 1 using a quick release bolt 140 for one axle of the bicycle or attachment portion, shown as a front fork 141 with supports 120 that extend outward to stabilize the rider and a narrow roller that is driven by the driving tire of the bicycle (FIG. 1). Configurations of attaching cylindrical rollers with a roller frame 61 intended to appropriately space the rollers and allow for adjustment of the cylinders for use with various bicycles may be employed.

Figure 11:
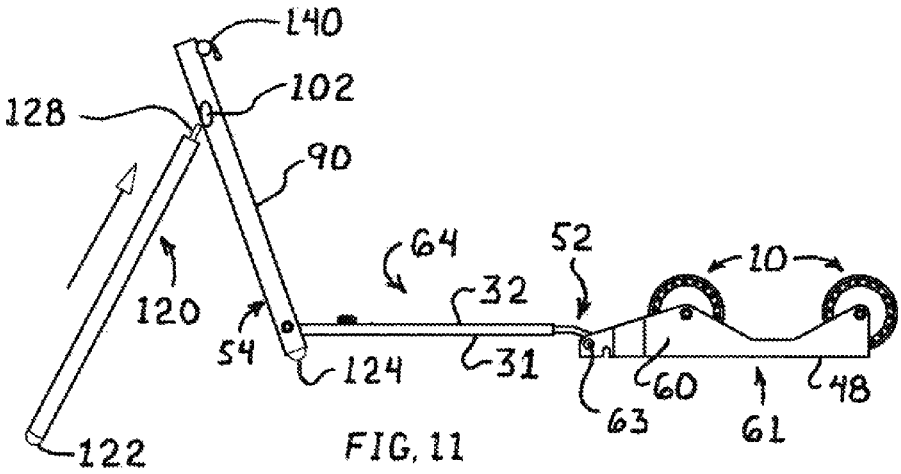
FIG. 11 is a side view of the device in the third step of unfolding.
Figure 16:
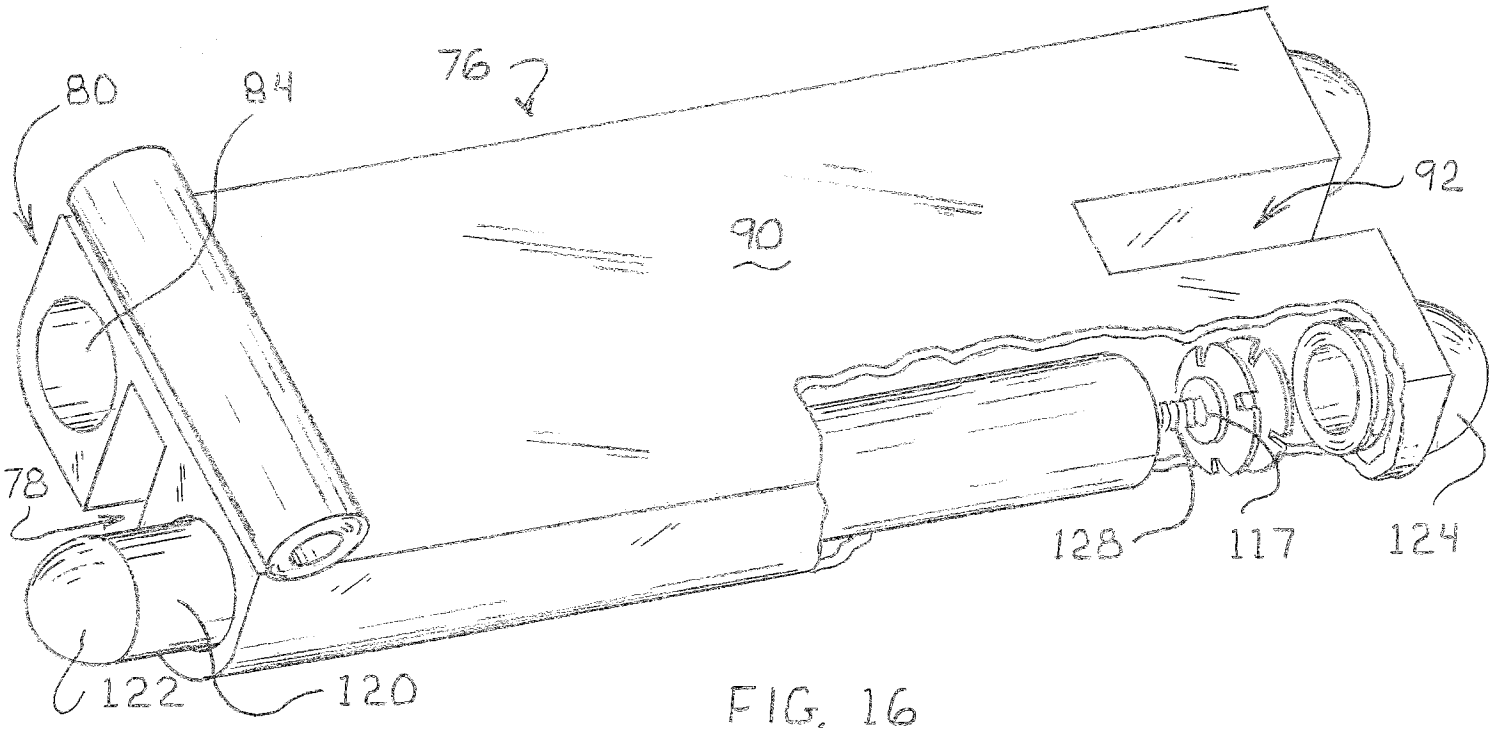
FIG. 16 is a partial section view of a support as stored in the front frame.
Figure 17:
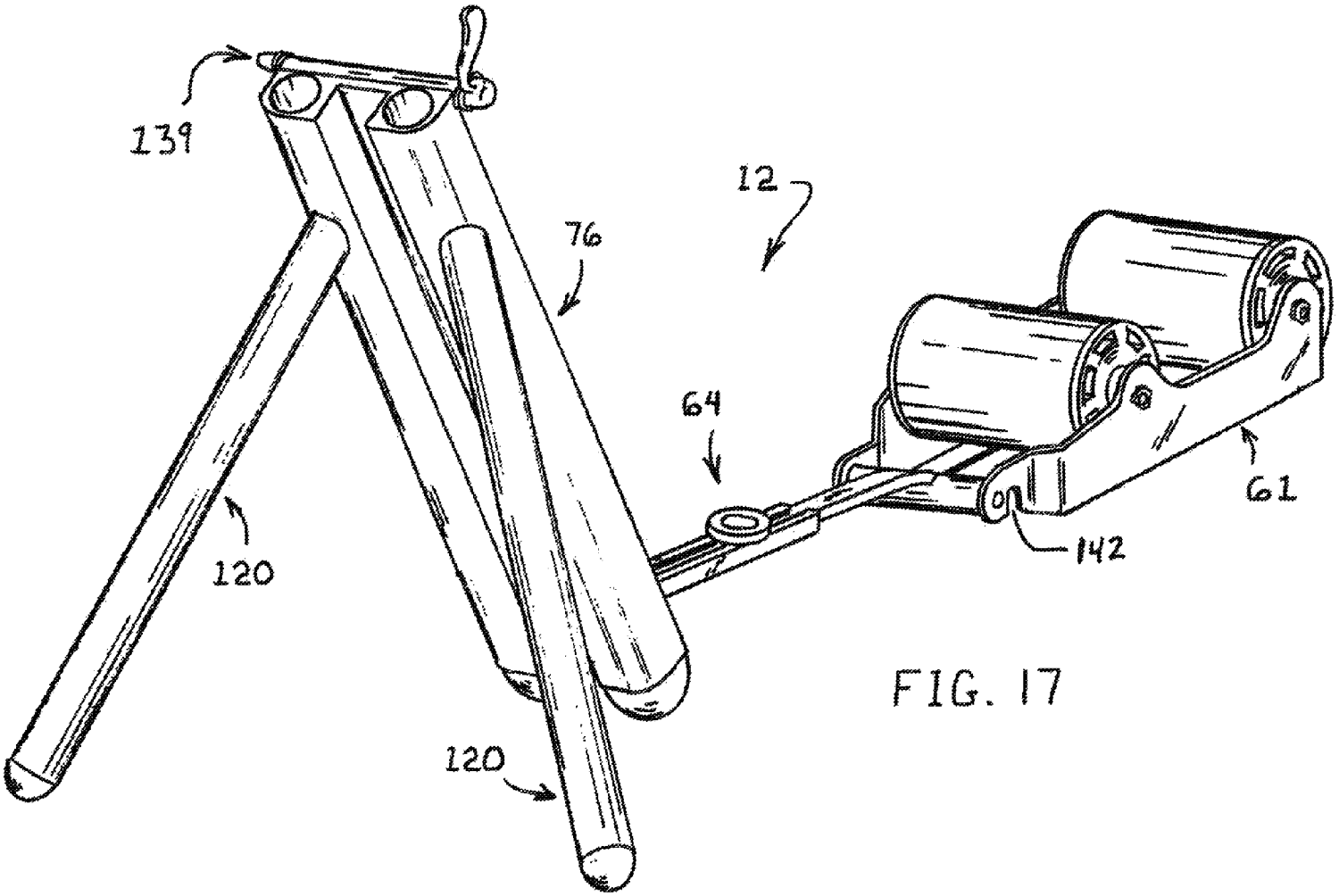
FIG. 17 is an assembled view of the device as shown in FIG. 2.

A roller frame 61 includes oppositely located sides 60 that support the axles 30 of the cylinders. The sides 60 have an upstanding portion 46 and a support portion 48 (FIG. 1). The upstanding portion 46 receives the progressive resistance devices 10 and affixes them using the axle 30. The opposing support portions 48 create a channel 33 as shown in FIG. 1. The roller frame 61 further includes a bolt 62 (FIG. 2) that extends between sides of the frame to pivotally hold an arm 64 at an arm attaching point 63. The arm has a first portion 66 and a second portion 68 (FIG. 12) that telescopingly slides over the first portion of the arm. The arm 64 has an upper surface 32 and a lower surface 31 and includes pivot points 52, 54 at each terminal end (FIG. 11). The pivot point 52 receives bolt 62 where it attaches to the roller frame 61, specifically sides 60. Pivot point 52 is offset from the main axis of the arm. The pivot point 54 is located oppositely and receives a bolt 94 (FIG. 2). The first portion 66 of the arm includes a bolt 70 (FIGS. 1 and 2) that is fixed within the first portion. The second portion 68 of the arm 64 includes a slot 74 that the bolt 70 slides within to allow telescoping. The portions 66, 68 of the arm 64 maybe slidingly adjusted and the nut 72 rotated to clamp them to a fixed and desired length. The arm 66 is pivotally connected to a front frame member 76. The front frame member 76 is an extrusion having a constant cross section for most of its length. The front frame member 76 includes two elongate tubes 80 that extend the length of the front frame member 76. Each tube 80 has a wall 82 with an inner surface 84. The tubes 80 are joined by a web 88 spanning between them on one side to form a flat side 90 (FIG. 1). Opposite the flat side 90 of the front frame member 76 is a groove 78 defined by the tubes 80 and the web 88. The web extends most of the length of the frame member 76 but is shortly less than the length of the tubes 80 and forms a notch 92 (FIG. 16) that extends between the tubes 80.

The arm 64 is pivotally connected to the front frame member 76 with a bolt 94 that extends through the tubes 80 that straddle the notch 92. The ends of the tubes 80 adjacent to the notch 92 receive plugs 124. The opposite ends of the tubes 80 are open. Intermediate to the ends of the tubes 80 are a pair of transverse holes 102. The transverse holes 102 have a first aperture 104 that is formed through wall 82 of the tube diagonally opposite where the web 88 joins each tube 80. The transverse hole has a perimeter that is circular in cross section. Each transverse hole 102 continues into its corresponding tube 80 to the inner surface 84 opposite the first aperture 104 to form a bottom portion of the transverse hole 102. The bottom portion of the hole 102 extends beyond the inner surface 84 but not through to the flat side 90 of the front frame. Where the web 88 joins each tube 80, there is optionally a gusset that is integral to the web 88 and corresponding tube 80. The gusset adds thickness where the web 88 joins each tube 80. The gusset is useful to provide additional material near the bottom portion of each transverse hole 102. The bottom portion is a cylindrical depression within the wall 82 having a flat circular bottom and a cylindrical perimeter. Within the flat circular bottom is a centrally located tapped hole 134. All shown in best detail on exploded FIG. 2.

Legs 120 are made from round tubular aluminum but can be made from other structural materials. One end of the leg 120 receives a plug 122 that provides a non-slip, non-marring end to the legs 120 that will rest on a floor. The plug 122 is shown as a rounded end rubber plug. The opposite end of the legs 120 are cut squarely to from a second end. From the center, near the second end of each leg 120 is an attaching end, shown as a threaded stud 128 extending therefrom. The threaded stud 128 is designed to be screwed into a threaded hole 134. When this is done, the transverse hole 102 sets an oblique angle between the legs 120 and the tubes 80 to which the legs 120 extend from. The second end fits within the bottom portion of its corresponding transverse hole 102 and is supported laterally by the perimeter in the inner surface near the bottom portion. The transverse hole 102 supports the leg 120 at a distance spaced from the bottom portion to provide a rigidly supported connection between the leg 120 and the front frame member 76.

When the legs 120 are not in the transverse holes 102, they are stored in the tubes 80. The inner surface 84 forms a cavity slightly larger than the outer diameter of the leg 120. The leg 120 is inserted into the tube 80. Each tube 80 includes a threaded hole 117 also referred to as a receiver that receives the stud 128 so that the leg 120 may securely held within a tube 80 when threaded stud 128 is screwed into a corresponding threaded hole 117.

The groove 78 is capable of receiving the arm 64 within it when the arm 64 is folded onto the front frame member 76. When the arm 64 is folded into the groove 78, it rests within the groove 78 and in between the two tubes 80. The arm 64 may be adjusted so that the length of the arm 64 locates the open ends of the tubes 80 adjacent to the pivot where the arm 64 is joined to the roller frame 61. From this position, the front frame member 76 may be folded to the sides of the roller frame 61 opposite where the cylinders are mounted. Because the cylinders have their outermost surface spaced from the bottom of the roller frame, the flat portion of the front frame member 76 may rest substantially aligned with the bottom of the roller frame when the front frame member 76 is folded in this position with respect to the roller frame 61. A quick release bolt 140 (FIG. 2) is located near the open ends of the tubes 80 on the front frame member 76. The quick release is received into notches 142 (FIG. 2) that are located between the pivot where the arm 64 is attached to the roller frame 61 and the cylinders. Once the quick release bolt 140 is located in the notches 142, it may be tightened to secure the entire resistance training device into a small portable package. This small folded resistance training device can fit easily into the overhead compartment of a plane for easy travel.

When the progressive resistance device is used, the driven wheel of a bicycle is placed on the two rear cylinders and the front wheel of a bicycle may be removed and the front axle or fork is mounted using the bolt 140 to the front frame 76 that supports the front and stabilizes the bicycle frame. In this application, not requiring the skill of the user to balance, the driven wheel of a bicycle is placed between the two roller cylinders and aligned in such a way that the tire of the bicycle, tricycle, or handcycle remains in contact with the roller cylinders during use. In a manner as is known, the user pedals the bicycle, tricycle or handcycle so as to rotate the driven wheel which in turn rotates the cylinder or cylinders supporting the driven wheel.

Figure 8:
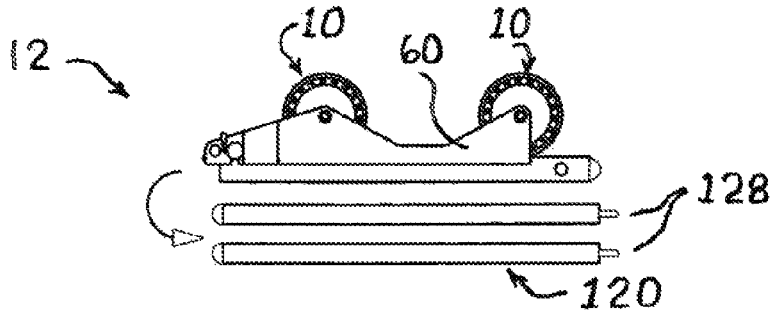
FIG. 8 is a side view of the device in the folded position.
Figure 9:
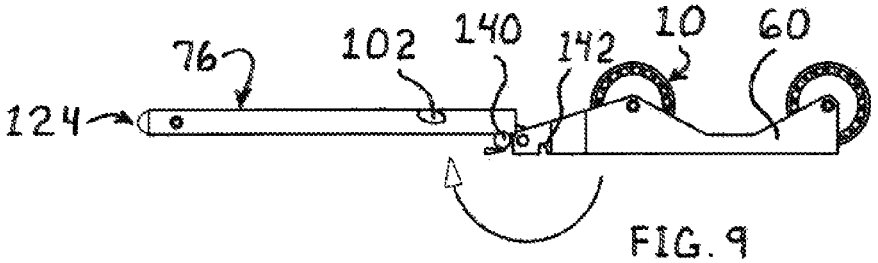
FIG. 9 is a side view of the device in the first step of unfolding.
Figure 10:
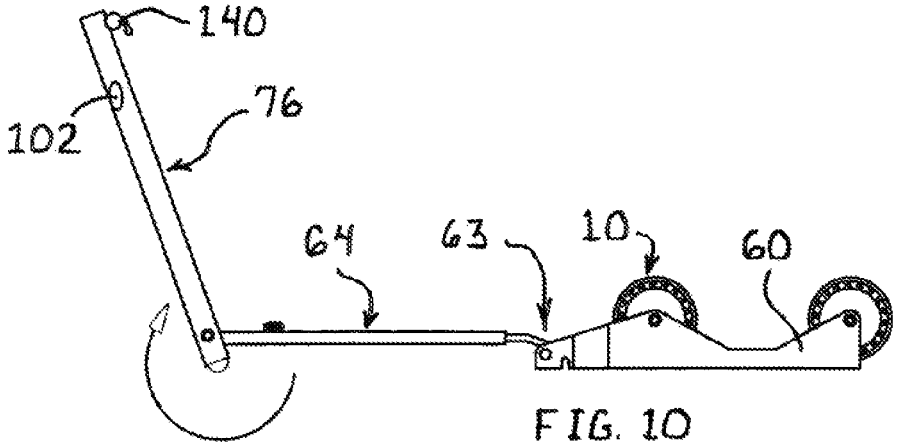
FIG. 10 is a side view of the device in the second step of unfolding.
Figure 12:
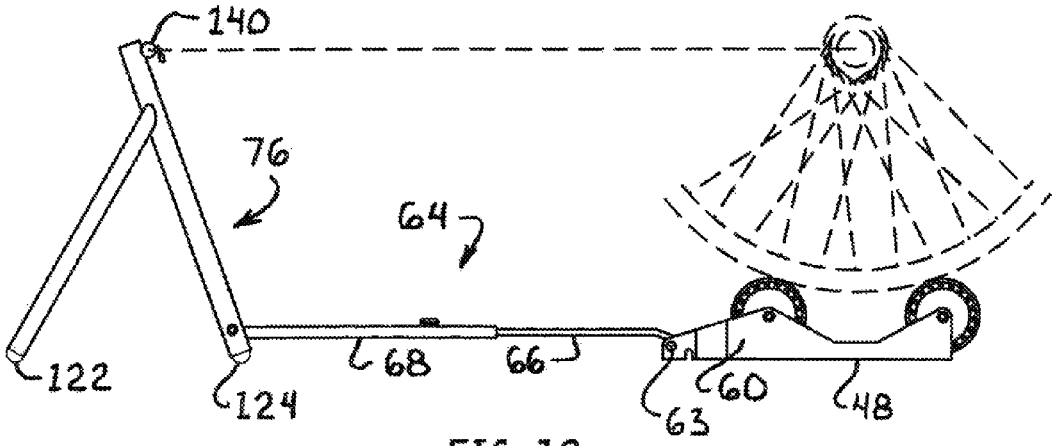
FIG. 12 is a side view of the device in the unfolded position.
Figure 13:
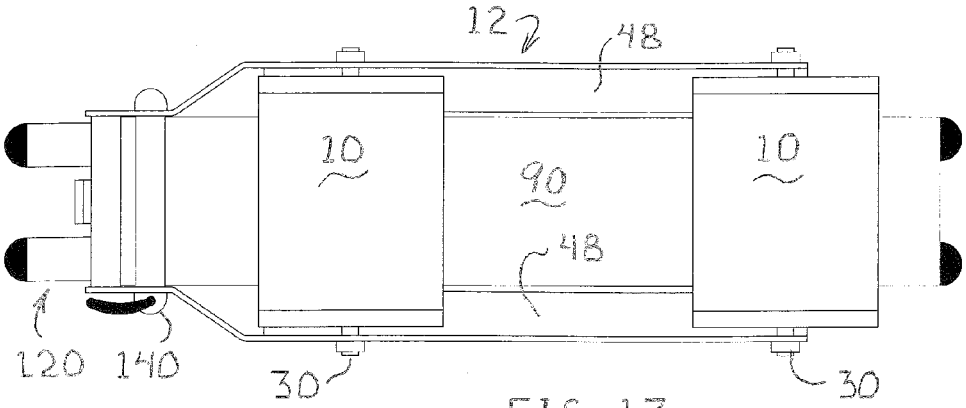
FIG. 13 is a top view of the device.
Figure 14:
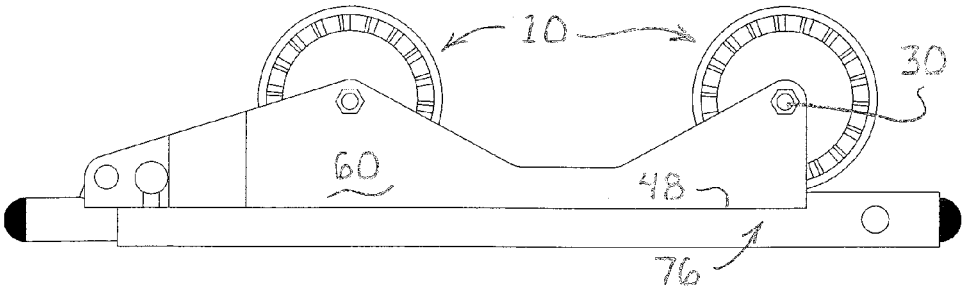
FIG. 14 is a side view of the device.
Figure 15:
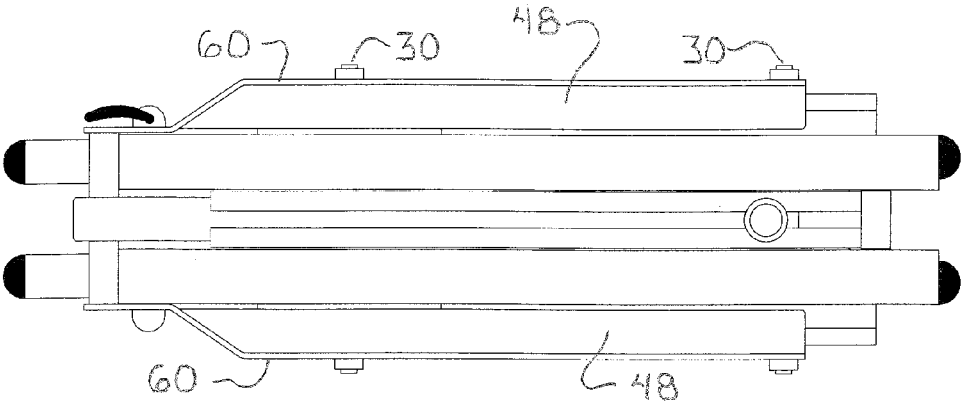
FIG. 15 is a bottom view of the device.

As is depicted in FIGS. 8-12, the device 12 can be converted between a stored configuration and a use configuration. The stored configuration is shown in FIGS. 13-15. The first step to convert the device 12 to the use configuration consists of freeing the legs 120. This consists of unthreading the stud 128 from the threaded hole 117 and sliding the leg 120 from the tube 80 as shown in FIG. 8. Next, the bolt 140 is loosened, freeing it from the notches 142, the release of bolt 140 and pivoting of the arm 64 and front frame 76 are shown in FIG. 9. The next step involves pivoting the front frame 76 from the arm 64. This is shown in FIG. 10. The next step is to secure the supports 120 in the transverse holes 102. This is shown in FIG. 11. The next step is to affix a bicycle or similar device to the bolt 140 and lock it down to secure it. In FIG. 1, the front fork of a bicycle is attached. Lastly, the arm 64 is adjusted by sliding the first portion 66 relative to second portion 68 in order to properly position the driving wheel of the bicycle or other device on the progressive resistance device 10 and the bolt 70 and nut 72 are used to fix the length of the arm 64. Proper positioning is shown in FIGS. 1 and 12. In use, the training device 12 contacts the floor on plugs 122 and 124 and support portion 48 of the roller frame 61.

In order to make the folded position of the training device 12 as compact as possible, the front frame 76 partially fits inside the channel that is created between the support portions 48 of the roller frame 61. The training device 12 can be fixed in the folded position by locking the bolt 140 in the notches 142. As shown in the folded and stored position in FIG. 13, the front frame is visible, specifically flat side 90. It is possible for the flat side 90 to directly contact the external surface 19 (FIG. 3) of the progressive resistance device 10.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A portable training device adapted to be used with a driving mechanism having a driving wheel and a mounting portion, said training device having:

a roller frame having an upstanding portion and a support portion, said support portion having a channel, said roller frame having an arm attaching point and a notch adapted to receive a portion of a front frame;

a resistance device rotatably affixed to said roller frame on an axle, said resistance device rotatable about a central axis and adapted to resist rotation with respect to said central axis;

a telescoping arm being an elongate member telescopingly fixable between a collapsed position and an extended position, said telescoping arm having an upper surface and a lower surface to define a thickness, said telescoping arm pivotably affixed at a first pivot point located at a first terminal end to said arm attaching point, said telescoping arm pivotably affixed at a second terminal end to a first distal end of said front frame, said first pivot point biased toward said lower surface;

said front frame being an elongate member having a second distal end located opposite said first distal end, said second distal end having a cycle attachment adapted to affix said mounting portion of said driving mechanism to said training device, said front frame including an aperture located between said first and second distal end, said aperture adapted to receive a support and obliquely angled with respect to said front frame, said front frame having a groove adapted to receive said telescoping arm;

said support being an elongate member having an attaching end adapted to be received by said aperture and affixed to said front frame;

said telescoping arm pivotable between a first position outwardly extending from said roller frame and a second position inverted with respect to said first position and overlaying said channel, said front frame is pivotable between a first position where said second distal end is located at a relatively far position from said roller frame, and a second position where said cycle attachment is located in said notch.

2. The portable training device of claim 1, a portion of said front frame is located in said channel when said front frame is in said second position.

3. The portable training device of claim 2, a portion of said telescoping arm is located in said groove when said front frame is in said second position.

4. The portable training device of claim 3, said groove in said front frame having a depth greater than said thickness of said telescoping arm.

5. The portable training device of claim 1, said resistance device having an inner cylinder having a wall defining a first inner chamber and said central axis, said resistance device having an outer cylinder having a wall, said outer cylinder being affixed to said inner cylinder and being rotatable about said central axis, said outer cylinder circumscribing said inner cylinder to define an annular space between said wall of said inner cylinder and said wall of said outer cylinder, said inner and outer cylinders being concentric, said axle extending through said central axis of said inner cylinder about which said inner and outer cylinders are rotatable, a pivotal magnet carrier pivotally mounted to said axle within said inner cylinder, a magnet affixed to said pivotal magnet carrier and spaced adjacent to said wall of said inner cylinder, within said inner cylinder sufficiently near to said inner cylinder to generate eddy currents when said inner cylinder is rotated with respect to said magnet, a spring, providing torsional resistive force to pivoting of said pivotal magnet carrier from eddy currents when said inner cylinder is rotated with respect to said axle.

6. The portable training device of claim 5, said pivotal magnet carrier has a first position wherein said magnet is spaced inwardly within said inner cylinder a distance relatively farthest from said inner cylinder and pivotable to a second position, locating said magnet relatively nearer to said inner cylinder than in said first position.

7. A portable training device having:

a roller frame having an upstanding portion, a support portion, and a channel, said roller frame having an arm attaching point and a notch;

a resistance device rotatably affixed to said upstanding portion on an axle, said resistance device rotatable about a central axis and adapted to resist rotation with respect to said axle;

an arm being an elongate member having an upper surface and a lower surface to define a thickness, said arm pivotably affixed at a first pivot point located at a first terminal end to said arm attaching point, said arm pivotably affixed at a second terminal end to a first distal end of a front frame;

said front frame being an elongate member having a second distal end located opposite said first distal end, said second distal end having a cycle attachment adapted to affix a portion of a cycle to said training device;

said arm moveable between a first position outwardly extending from said roller frame and a second position inverted with respect to said first position and partially located in said channel, said front frame is moveable between a first position where said second distal end is located at a relatively far position from said roller frame, and a second position where said second distal end is adjacent to said roller frame; and a portion of said front frame is located in said channel when said front frame is in said second position, said front frame having a groove spanning said first and second distal ends, a portion of said arm is located in said groove when said front frame is in said second position.

8. The portable training device of claim 7, said resistance device having a first cylinder having a wall defining a first inner chamber and said central axis, said resistance device having a second cylinder, affixed to said first cylinder, having a wall and rotatable about said central axis, said second cylinder circumscribing said first cylinder to define an annular space between said wall of said first cylinder and said wall of said second cylinder, said first and second cylinders being concentric, said axle extending through said central axis of said first cylinder about which said first and second cylinders are rotatable, a pivotal magnet carrier pivotally mounted to said axle within said first cylinder, a magnet affixed to said pivotal magnet carrier and spaced adjacent to said wall of said first cylinder, within said first cylinder sufficiently near to said first cylinder to generate eddy currents when said first cylinder is rotated with respect to said magnet, a spring, providing torsional resistive force to pivoting of said pivotal magnet carrier from eddy currents when said first cylinder is rotated with respect to said axle.

9. The portable training device of claim 8, said arm being telescopically slidable between an expanded and a compressed position, said arm fixable at a position between said expanded and compressed positions.

10. The portable training device of claim 9, said first pivot point offset from a central axis of said arm.

11. The portable training device of claim 10, said front frame having an aperture adapted to receive a support, said support being an elongate member and supporting a portion of said front frame when said support is received in said aperture.

12. The portable training device of claim 11, said support obliquely angled with respect to said front frame when said support is received in said aperture.

13. The portable training device of claim 7, said front frame member having a tube with an opening at said second distal end, said tube adapted to receive a support, said tube having a receiver adapted to affix said support at an attaching end when said support is located in said tube.

* * * * *